US006269591B1

(12) United States Patent
Kelly

(10) Patent No.: US 6,269,591 B1
(45) **Date of Patent: *Aug. 7, 2001**

(54) ADJUSTABLE THRESHOLD PROTECTIVE COVER WITH REMOVABLE SECTIONS

(76) Inventor: Donald R. Kelly, P.O. Box 48282, Watauga, TX (US) 76148

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/435,162

(22) Filed: Nov. 5, 1999

(51) Int. Cl.[7] ..... E06B 7/16; E06B 1/70
(52) U.S. Cl. ..... 49/482.1; 49/68; 52/100
(58) Field of Search ..... 49/482.1, 475.1, 49/467, 468; 52/656.4, 717.01, 100, 207, 210, 211

(56) References Cited

U.S. PATENT DOCUMENTS

| | | | | |
|---|---|---|---|---|
| 588,626 | | 8/1897 | Baumann . | |
| 767,615 | | 8/1904 | Webber . | |
| 1,348,396 | | 8/1920 | Dubee . | |
| 1,543,034 | | 6/1925 | Stevens . | |
| 1,966,402 | | 7/1934 | Barringer . | |
| 1,979,691 | * | 11/1934 | Jackson | 428/318.6 |
| 2,132,471 | | 10/1938 | Hoffman . | |
| 2,385,612 | * | 9/1945 | Coutlee | 242/166 |
| 2,722,724 | | 11/1955 | Miller . | |
| 2,999,280 | | 9/1961 | Miller . | |
| 3,250,040 | * | 5/1966 | Squires | 49/428.1 |
| 4,272,931 | * | 6/1981 | Stanizzo | 52/98 |
| 4,288,482 | * | 9/1981 | Beck | 428/92 |
| 4,492,062 | | 1/1985 | Levenez . | |
| 4,768,320 | * | 9/1988 | Weller | 52/211 |
| 4,923,348 | | 5/1990 | Carlozzo . | |
| 4,956,940 | | 9/1990 | Touton, III . | |
| 5,010,691 | * | 4/1991 | Takahashi | 49/482.1 |
| 5,093,181 | * | 3/1992 | Sanchez | 428/167 |
| 5,203,130 | * | 4/1993 | Freelove | 52/211 |
| 5,611,173 | * | 3/1997 | Headrick et al. | 49/468 |
| 5,638,641 | * | 6/1997 | Joffe et al. | 49/469 |
| 5,653,072 | * | 8/1997 | Seelandt-Stasek et al. | 52/204.1 |
| 5,673,517 | | 10/1997 | Stanclift . | |
| 5,769,562 | * | 6/1998 | Jones | 404/7 |
| 5,953,881 | * | 9/1999 | Sherry | 52/746.1 |
| 6,044,600 | * | 4/2000 | McCollough | 52/209 |

* cited by examiner

*Primary Examiner*—Gregory J. Strimbu
(74) *Attorney, Agent, or Firm*—Rudolf O. Siegesmund

(57) ABSTRACT

An adjustable threshold protector to be used during the construction of a house or building is an apparatus made of durable material covering the threshold, removably attached to the threshold and which can be adjusted in width and length by removable sections to fit a wide variety of doorway thresholds.

10 Claims, 2 Drawing Sheets

30
31
32
33
34
35
36
37
38
52
2
2
57
56
11
13
44
45
46
16
18
40
41
42
12
14
10

ADJUSTABLE THRESHOLD PROTECTIVE COVER WITH REMOVABLE SECTIONS

FIELD OF THE INVENTION

The present invention is directed, in general, to an improved protective covering for the thresholds of doorways in houses or buildings under construction that can be modified by breaking off sections along built in serrations to facilitate covering the doorway with an appropriate width and that can also be cut to shorten the length of the protector for smaller threshold lengths.

BACKGROUND OF THE INVENTION

During the construction of houses and buildings doorframes are installed in the building at an early stage. After installation, workers tread upon the threshold in shoes or boots, that carry mortar, dirt and rocks on the soles. Workers wheel or drag equipment into the house or building subjecting the threshold to scraping and impact. Bricks may be placed on the threshold or fall onto the threshold by workmen installing the exterior brick. Mortar, paint and chemicals, such as lacquer or thinner, can drip onto the threshold during varying phases of construction resulting in discoloration or damage. During the acid wash of the exterior brick, hydrochloric acid can fall onto the threshold causing additional discoloration or damage.

Removing dirt, rocks, mortar, paint, thinner, lacquer or acid discoloration from the threshold of a doorway takes one worker from fifteen to thirty minutes per doorway. In a typical residential construction with three doorways, three quarters of one man hour to one and one-half man hours of labor are required for the clean-up. Moreover, the clean-up work cannot remove scratches or dents. If a drop cloth is thrown over the threshold, it may not stay in place, or it will wear out before the construction is completed. More importantly, a drop cloth will be a hazard for workers who may trip over the loose material thereby causing increased expenses through on the job injuries and lost time. Putting tape on the threshold requires a good deal of time and will not survive the entire construction cycle due to the traffic and loads to be borne. Therefore, a need exists for an inexpensive disposable threshold protector that will have sufficient durability to last the entire construction period of the house or building.

Additionally, protection of thresholds is beneficial during moving of furniture, installation of new doors and during remodeling of existing buildings.

The prior art does not disclose such a protector. There are many examples of thresholds; however, no device has been patented to provide for the protection of the threshold during the construction of the house or building. U.S. Pat. No. 4,492,062 to Levenez discloses a window sill assembly for protecting and covering an existing window sill at the base of the window. The device is meant for permanent installation and is not adaptable to door thresholds.

Applicant disclosed a threshold protective cover in U.S. patent application Ser. No. 09/247,798 which could be made in any number of sizes; however, a single threshold protective cover was not designed to be adaptable to various widths and lengths of doorways. A need exists for an improved threshold protective cover that can be adjusted in width and length, easily and economically, so that one threshold protective cover can be used for a wide variety of doorways.

SUMMARY OF THE INVENTION

A threshold protector to be used during the construction of a house or building is an apparatus made of durable material covering the threshold, removably attached to the threshold and which can be adjusted in width and length to fit a wide variety of doorway thresholds.

BRIEF DESCRIPTION OF THE DRAWINGS

The apparatus of the invention is further described and explained in relation to the following figures of the drawings wherein.

DESCRIPTION OF PREFERRED EMBODIMENTS

In the discussion of the figures, the same numbers will be used to refer to the same or similar components throughout. The term threshold as used herein is defined as the plank, timber, metal piece or stone lying under the door of a building and as used herein has the same meaning as the term doorsill which is defined as the horizontal lower member of a door casing. Adhesive tape is defined as a piece or strip of paper, fabric, vinyl, or metal coated with an adhesive substance such as a glue or paste capable of adhering to a range of surfaces such as wood, metal, plastic, vinyl or stone. By double sided adhesive tape is meant tape with adhesive on a side that can be affixed to one surface and another side that can be affixed to a second surface. By adhering is meant the ability to stick fast or together while allowing removal without damage to the surface to which the adhesive is applied. By covering is meant placing something over or upon the threshold for the purpose of protecting the threshold. By doorway is meant a passage for entrance and exit into and out of a house, building or room wherein the doorway contains a door and door frame used for closing or opening the passage. By non-skid surface is meant a surface that has been roughened so that traction is improved between the soles of human footgear and the non-skid surface. A non-skid surface be either molded into the material of the surface or it may be applied with one sided adhesive tape.

Figures 1, 2, 3:
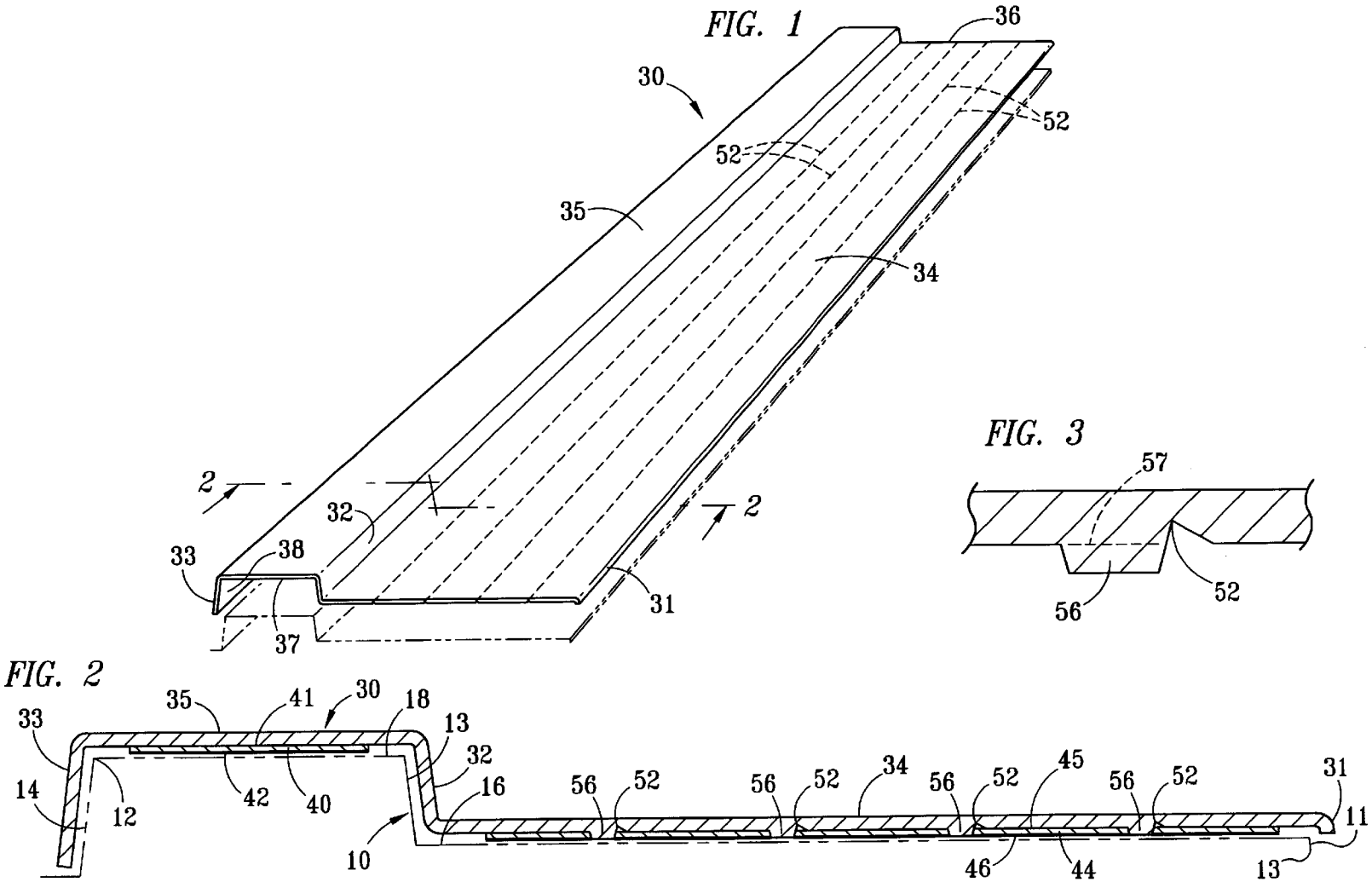
FIG. 1 is a perspective view of the improved threshold cover with the score or cut lines shown by hidden lines.
FIG. 2 is a section taken on 2—2 of FIG. 1.
FIG. 3 is an enlarged portion of FIG. 3.

According to the present invention, FIG. 1 depicts cover 30 showing the general shape and profile. Cover 30 has front flange 31, first top section 34, vertical section 32, second top section 35 and rear flange 33. Cover 30 has first side 36, second side 37 and bottom surface 38. Either one or both of first top section 34 and second top section 35 may be molded with a built-in non-skid surface(not shown). Moreover, either one or both of first top section 34 and second top section 35 can have a non-skid surface affixed by means of an adhesive backing on the non-skid material.

FIG. 2 shows threshold 10 with cover 30 positioned on threshold 10. Threshold 10 has front edge 11 and rear edge 12. Threshold 10 has main step 16, door step 18, first face 13 and second face 14. In FIG. 2 cover 30 is viewed from second side 37. Cover 30 is affixed to threshold 10 by first tape 40 and second tape 44. Cover 30 has four flanges 56 and four notches 52. However, any number of flanges 56 and notches 52 could be utilized in order to increase the adaptability of cover 30. Flange 56 is followed by notch 52 so that first top section 34 can be bent upward and broken off along notch 52 to achieve the desired width of cover 30 while leaving a flange at the new forward edge of cover 30. Alternatively, first top section 34 can be flexed back and forth along notch 52 until the outer portion of first top section 34 breaks and separates from the remainder of first top section 34. Second tape 44 extends under first top section 34 in a continuous piece and can be perforated or pre-cut to facilitate separating when first top section 34 is manipulated to separate the desired outward section or sections from first top section 34.

Cover 30 is made of molded plastic, polyurethane, polyvinyl chloride, rubber, wood, cardboard or any suitable commercially available material capable of being molded into a single unitary piece. Cover 30 can be made from any material which has the characteristics of durability and resiliency to dirt, water, chemicals, abrasion and impact. In the preferred embodiment, Cover 30 is manufactured in a mold so that there are no seams or breaks between the various sections. Alternatively, Cover 30 could be heat pressed from a single sheet of plastic or synthetic material. Cover 30 could also be stamped or pressed from a single piece of metal. As a further alternative cover 30 could be assembled by spot welding, gluing or taping.

Cover 30 can function to protect the threshold by aligning cover 30 above threshold 10 and lowering cover 30 onto threshold 10. Cover 30 can be made more secure by means of adhesive. First tape 40 is affixed to bottom surface 38 beneath second top section 35. Second tape 44 is affixed to bottom surface 38 beneath first top section 34. First tape 40 is a double sided tape with adhesive on both sides so that first adhesive surface 41 of first tape 40 is covered with an adhesive compound such as glue, paste or rubber cement so that when pressed against bottom surface 38 of first cover 30 first tape 40 will be fixedly attached to first cover 30. Second adhesive side 42 of first tape 40 also has adhesive covering second adhesive side 42. Adhesive on second adhesive side 42 can be covered with removable foil or paper which can be peeled off prior to installation of first cover 30 to threshold 10. Likewise, second tape 44 is double sided tape with adhesive on both sides so that third adhesive side 45 of second tape 44 is covered with an adhesive compound such as glue, paste or rubber cement so that when pressed against bottom surface 38 of first cover 30 second tape 44 will be attached to first cover 30. Fourth adhesive side 46 of second tape 44 also has adhesive covering fourth adhesive side 46. Adhesive on fourth adhesive side 46 can be covered with removable foil or paper which can be peeled off prior to installation of first cover 30 to threshold 10.

Cover 30 is installed on threshold 10 by removing any paper or foil to expose adhesive on second adhesive side 42 of first tape 40 and fourth adhesive side 46 of second tape 44, aligning cover 30 with threshold 10 and lowering cover 30 onto threshold 10 and pressing down manually on first top section 34 to engage adhesive from fourth adhesive side 46 to main step 16 of threshold 10. Pressing down manually on second top section 35 will engage adhesive from second adhesive side 42 to door step 18 of threshold 10.

FIG. 3 is a cross sectional view of cover 30 along line 2—2. Flange 56 and notch 52 are shown. Notch 52 runs the length of cover 30 from first side 36 to second side 37 (See FIG. 1). In the preferred embodiment, notch 52 is made by scoring. However, notch 52 can also be molded into cover 30. The purpose of notches 52 are to allow breaking cover 30 along the line defined by the notch 52 selected for breaking cover 30 and thereby separating a pre-selected portion of cover 30 from the main body of cover 30. The purpose of flange 56 is so that when cover 30 is broken along a line defined by a notch 52, that cover 30 will have a flange 56 to replace front flange 31 which will have been removed. Dotted line 57 depicts a break in flange 56 which will be shown in FIGS. 4 and 5.

Figure 4:
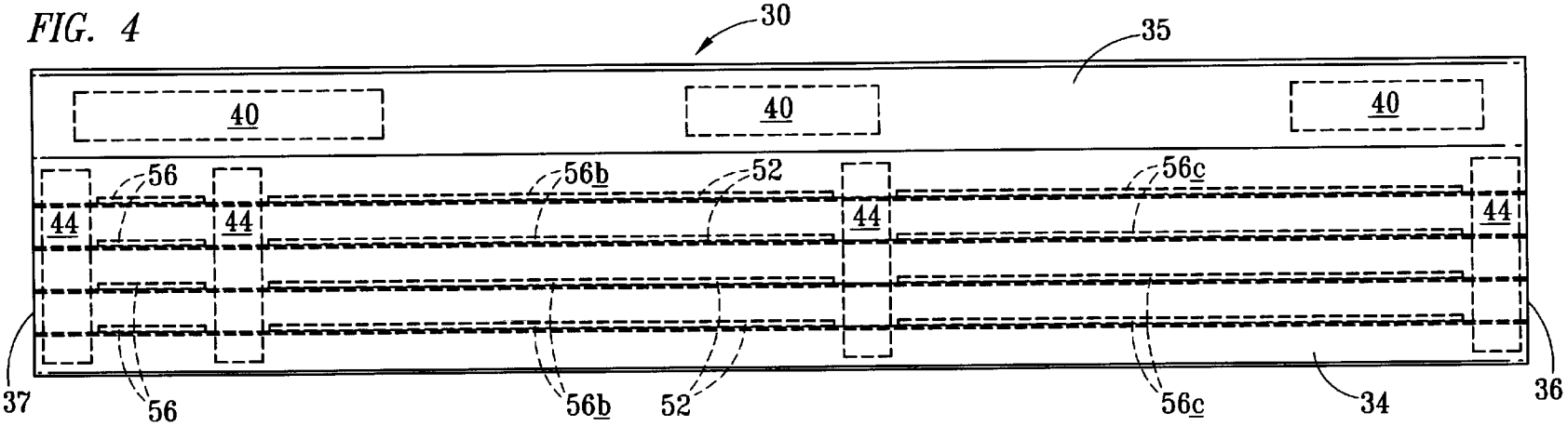
FIG. 4 is a top view of the improved threshold cover.

FIG. 4 is a top view of cover 30. Flanges 56 and notches 52 are shown by dotted lines. First tapes 40 and second tapes 44 are also shown by dotted lines as they cannot be seen from the top. In FIG. 4, Flanges 56 do not run continuously the length of cover 30 but rather flanges 56 begin after a space for a second tape 44 and continue for a distance which is less than ¼ the length of cover 30. Another space is left for another second tape 44 and then flange 56*b* continues for a distance which is more than ¼ the length of cover 30 and less than ½ the length of cover 30. After flange 56*b* another space is left for another second tape 44 and then flange 56*c* begins and continues until another space for a second tape 44 is left. After the space for second tape 44, cover 30 ends in first end 36. Three positions are shown for first tapes 40 under second top section 35. First tape 40 could be one continuous piece or first tape 40 could be any number of pieces. In the preferred embodiment any number of first tapes 40 from one to three are satisfactory. Moreover, additional second tapes 44 could be added to underside 38 of cover 30 by creating additional spaces for second tapes 44 and decreasing the size of flange 56*a* and flange 56*b* and adding additional flanges 56*a* and 56*b* as necessary to place flanges 56*a* and flanges 56*b* between the additional spaces for second tapes 44.

The purpose of having flange 56 extend for a shorter distance than flange 56*a* or flange 56*c* is that the length of cover 30 can be shortened by cutting cover 30 along a line parallel to second side 37 and extending through the space for second tape 44 between flange 56 and flange 56*a*. Cover 30 would be cut using a standard handsaw or cover 30 could be cut using a circular table saw. In FIG. 4, flange 56 is shown positioned near second side 37; however, flange 56 could be positioned near first side 36 so that flange 56 would follow flange 56*c* and a space for a second tape 44. Flange 56 would then be followed by a space for a second tape 44 and then cover 30 would end in first side 36.

Figure 5:
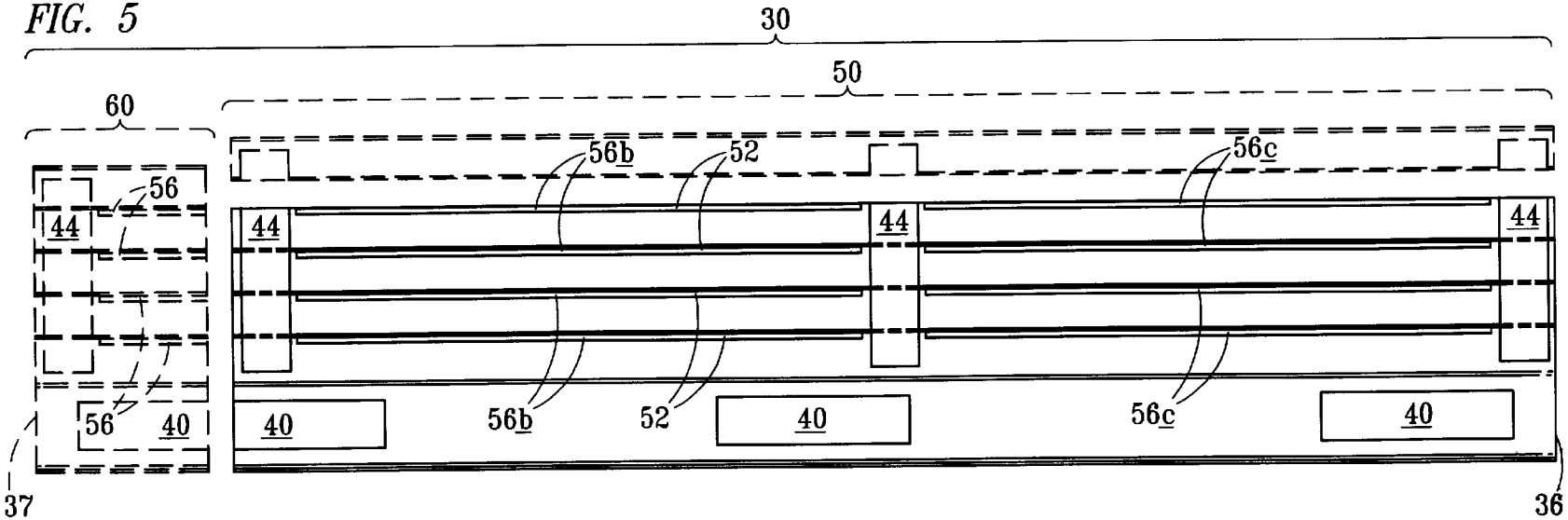
FIG. 5 is a bottom view of the adjustable threshold cover with removable width section 50 detached and front section 60 detached showing the modification for a smaller doorway.

FIG. 5 depicts a bottom view of cover 30 with the flank section 60 removed and removable width section 50 removed from the length of cover 30. In FIG. 5, flanges 56 are positioned near second side 37 so that second side 37 is followed by a space for a second tape 44 and then flanges 56. Flanges 56 are followed by a space for a second tape 44 and then flanges 56*b*. Flanges 56*b* are followed by a space for a second tape 44 and then flanges 56*c*. Flanges 56*c* are followed by a space for a second tape 44 and then cover 30 ends at first side 36. In FIG. 5, flank section 60 has been removed by cutting cover 30 along a line parallel to second side 37. Also shown in FIG. 5, removable width section 50 has been removed by bending removable width section 50 along notch 52 which runs the entire length of cover 30 next to flanges 56, flanges 56*a* and flanges 56*b*. In FIG. 5, only the first removable width section 50 has been removed; however, any number of sections could be removed by selecting the appropriate notch 52 along which to bend the outermost portion of cover 30.

Those skilled in the art should appreciate that the conception and the specific embodiment disclosed may be readily utilized as a basis for modifying or designing other structures for carrying out the same purposes of the present invention. Those skilled in the art should also realize that such equivalent constructions do not depart from the spirit and scope of the invention as set forth in the appended claims. Other alternatives and modifications of the invention will likewise become apparent to those of ordinary skill in the art upon reading the present disclosure, and it is intended that the scope of the invention disclosed herein be limited only by the broadest interpretation of the appended claims to which the inventor is legally entitled.

What is claimed is:

1. An adjustable threshold protector for a doorway threshold having a main step and a door step comprising a cover having a first top section, a vertical section, a second top section, and a rear flange;

wherein said vertical section, said second top section and said rear flange define a channel which is adapted to engage said door step;

wherein said first top section comprises a front flange, at least one replacement flange and at least one notch;

wherein said at least one notch is disposed between said front flange and said at least one replacement flange on a surface of said first top section which in use is adapted to face downwardly toward the main step;

wherein said at least one notch defines a removable section of said first top section;

wherein said removable section is separable from said first top section by bending said removable section at said at least one notch so that when said removable section is removed from said first top section, said at least one replacement flange is disposed at a distal end of said first top section; and wherein said front flange extends downward at approximately ninety degrees to said removable section and said replacement flange extends downward at approximately ninety degrees to said first top section.

2. The adjustable threshold protector of claim 1 wherein the first top section further comprises a non-skid surface and the second top section further comprises a non-skid surface.

3. The adjustable threshold protector of claim 1 having at least one first tape fixedly engaged to said second top section.

4. The adjustable threshold protector of claim 1 having at least one second tape fixedly engaged to said first top section.

5. The adjustable threshold protector of claim 1 further comprising a flank section adapted to be separated by cutting.

6. An adjustable threshold protector for a doorway threshold having a main step and a door step comprising:

a cover having a first top section adapted for removable engagement to said main step, a vertical section, a second top section adapted for removable engagement to said door step, and a rear flange;

wherein said first top section comprises a front flange, at least one replacement flange and at least one notch;

wherein said at least one notch is disposed between said front flange and said at least one replacement flange on a surface of said first top section which in use is adapted to face downwardly toward the main step;

wherein said at least one notch defines a removable section of said first top section;

wherein said removable section is separable from said first top section by bending said removable section at said at least one notch so that when said removable section is removed from said first top section, said at least one replacement flange is disposed at a distal end of said first top section; and wherein said vertical section, said second top section and said rear flange define a channel adapted to engage said door step.

7. The adjustable threshold protector of claim 6 further comprising at least one first tape fixedly engaged to said second top section.

8. The adjustable threshold protector of claim 6 further comprising at least one second tape fixedly engaged to said first top section.

9. The adjustable threshold protector of claim 6 further comprising a flank section adapted to be separated by cutting.

10. An adjustable threshold protector for a doorway threshold, having a main step and a door step, comprising:

a cover comprising:

a first top section;

a second top section;

a vertical section;

a rear flange;

at least one first tape fixedly engaged to said second top section;

at least one second tape fixedly engaged to said first top section;

at least one short flange section;

a flank section adapted to be separated by cutting;

wherein said first top section comprises a front flange, at least one replacement flange and at least one notch;

wherein said at least one notch is disposed between said front flange and said at least one replacement flange on a surface of said first top section which in use is adapted to face downwardly toward the main step;

wherein said at least one notch defines a removable section of said first top section:

wherein said removable section is separable from said first top section by bending said removable section at said at least one notch so that when said removable section is removed from said first top section, said at least one replacement flange is disposed at a distal end of said first top section; and wherein said first tape is adapted for engaging said second top section to said door step and said second tape is adapted for engaging said first top section to said main step; and wherein said vertical section, said second top section and said rear flange define a channel adapted to engage said doorstep.

* * * * *